US010087628B2

(12) United States Patent
Shuhaibar

(10) Patent No.: US 10,087,628 B2
(45) **Date of Patent: *Oct. 2, 2018**

(54) STRUCTURAL SYSTEM AND METHOD USING MONOLITHIC BEAMS HAVING IMPROVED STRENGTH

(71) Applicant: Constantine Shuhaibar, San Francisco, CA (US)

(72) Inventor: Constantine Shuhaibar, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/782,932

(22) Filed: Oct. 13, 2017

(65) Prior Publication Data

US 2018/0038105 A1 Feb. 8, 2018

Related U.S. Application Data

(63) Continuation-in-part of application No. 14/940,051, filed on Nov. 12, 2015, now Pat. No. 9,809,978.

(60) Provisional application No. 62/188,726, filed on Jul. 5, 2015.

(51) Int. Cl.

| | |
|---|---|
| ***E04C 3/06*** | (2006.01) |
| ***E04C 3/293*** | (2006.01) |
| ***E04C 3/04*** | (2006.01) |

(52) U.S. Cl.

CPC ..... *E04C 3/06* (2013.01); *E04C 3/293* (2013.01); *E04C 2003/043* (2013.01); *E04C 2003/0434* (2013.01); *E04C 2003/0452* (2013.01); *E04C 2003/0465* (2013.01); *E04C 2003/0473* (2013.01)

(58) Field of Classification Search

CPC .... E04C 3/06; E04C 2003/0452; E04C 3/294; Y10T 29/49632

USPC ..... 52/837

See application file for complete search history.

(56) References Cited

U.S. PATENT DOCUMENTS

| | | | | |
|---|---|---|---|---|
| 620,561 | A * | 3/1899 | Bettendorf | 105/226 |
| 2,028,169 | A * | 1/1936 | Sahlberg | E04C 3/294 29/897.34 |
| 3,054,486 | A * | 9/1962 | De La Rambelje | E04G 11/56 29/446 |

(Continued)

FOREIGN PATENT DOCUMENTS

WO WO 8502432 A1 * 6/1985 ..... E01D 2/02

*Primary Examiner* — Rodney Mintz

(74) *Attorney, Agent, or Firm* — Convergent Law Group LLP

(57) ABSTRACT

Exemplary embodiments include a structural system for replacing a standard beam. The standard beam has a weight per unit length, a depth in a load direction, a characteristic cross-sectional shape and a width in a cross direction substantially perpendicular to the load direction. The structural system includes a monolithic beam having the characteristic cross-sectional shape and the depth in the load direction. The monolithic beam may also have the weight per unit length. The monolithic beam includes first and second flanges connected by a transverse section. The first and second flanges extend in the cross direction and have first and second thicknesses, respectively, in the load direction. The flanges are not wider than the width in the cross direction. At least one of the flanges has the width in the cross direction. The thicknesses are different. The flanges and the transverse section are an integrated structure forming the monolithic beam.

18 Claims, 5 Drawing Sheets

(56) References Cited

U.S. PATENT DOCUMENTS

| | | | | | |
|---|---|---|---|---|---|
| 4,709,456 | A * | 12/1987 | Iyer | E04C 3/10 | 14/74.5 |
| 5,487,199 | A * | 1/1996 | Nelson | E01D 19/00 | 14/74.5 |
| 5,600,932 | A * | 2/1997 | Paik | E04C 3/06 | 29/401.1 |
| 5,924,316 | A * | 7/1999 | Streubel | B21C 37/065 | 72/367.1 |
| 9,809,978 | B2 * | 11/2017 | Shuhaibar | E04C 3/06 | |
| 2009/0229219 | A1 * | 9/2009 | Rutman | E04C 3/08 | 52/836 |
| 2012/0227354 | A1 * | 9/2012 | Hauta-Aho | B23K 31/022 | 52/831 |
| 2012/0328898 | A1 * | 12/2012 | Strickland | B62D 21/02 | 428/594 |
| 2014/0041229 | A1 * | 2/2014 | Smith | B21D 5/16 | 29/897 |
| 2014/0053501 | A1 * | 2/2014 | Hauta-Aho | B23K 31/022 | 52/836 |
| 2017/0002565 | A1 * | 1/2017 | Shuhaibar | E04C 3/06 | |
| 2017/0328633 | A1 * | 11/2017 | Kanzler | F25J 3/04909 | |
| 2018/0030730 | A1 * | 2/2018 | Shuhaibar | E04C 3/06 | |

* cited by examiner

STRUCTURAL SYSTEM AND METHOD USING MONOLITHIC BEAMS HAVING IMPROVED STRENGTH

CROSS-REFERENCE TO RELATED APPLICATIONS

This application claims the benefit of patent application Ser. No. 14/940,051, filed Nov. 12, 2015 entitled "STRUCTURAL SYSTEM AND METHOD USING MONOLITHIC BEAMS HAVING IMPROVED STRENGTH", which claims the benefit of provisional Patent Application Ser. No. 62/188,726, filed Jul. 5, 2015, and entitled "STRUCTURAL SYSTEM AND METHOD USING MONOLITHIC BEAMS HAVING IMPROVED STRENGTH" both incorporated herein by reference.

BACKGROUND

Modern buildings are constructed using beams, typically steel beams, and concrete. This combination of the steel beam, concrete and any shear studs form a composite beam. Standard steel beams have a characteristic cross-sectional shape, a depth, a width and a weight per unit length. Such standard beams are designated based on their characteristic cross-sectional shape. For example, common standard steel beams include I-beams, channel beams, angle beams as well as other beams. An I-beam has a characteristic cross-sectional shape of an "I". In other words, such a beam has two flanges corresponding to the top and bottom of the "I" connected near their centers by a transverse section, or web, corresponding to the vertical section of the "I". The depth is the distance from the top/outer surface of the top flange to the bottom/outer surface of the bottom flange. The width of such a beam is the width of the wider flange. Typically, the load direction is between the flanges of the I-beam, along the transverse section. The weight of the concrete on the standard beam is generally in the load direction. The flanges extend in the cross direction, which is substantially perpendicular to the load direction. A channel beam, also termed a "C" beam, includes top and bottom flanges connected at their ends by a transverse section. The depth and width of the channel beams are defined in a similar manner to the I-beam. Depending on the widths of the flanges, the actual shape of the "I" and the "C" may differ.

Standard steel beams are selected based upon their characteristic cross-sectional shape, depth, and weight per unit length. Typically, structural engineers consult well known tables that indicate the characteristics of the beams based on these properties. Note, however, that the depth and weight per unit length may differ for standard beams in different locations. For example, in the United States, the depth and weight per unit length are based on the English system (inches and pounds per foot). In the European Union, the depth and weight per unit length are based on the metric system. However, the characteristic shapes may be the same.

Although composite beams, and thus standard steel beams, are virtually ubiquitous in urban architecture, improvements are desired. For example, improvements in strength, ability to support concrete and other features would be beneficial. Accordingly, a mechanism for improving structural beams is desired.

BRIEF SUMMARY

A structural system for replacing a standard beam is described. The standard beam has a weight per unit length, a depth in a load direction, a characteristic cross-sectional shape and a width in a cross direction substantially perpendicular to the load direction. The structural system includes a monolithic beam having the characteristic cross-sectional shape and the depth in the load direction. In some aspects, the monolithic beam also has the weight per unit length of the standard beam. The monolithic beam includes a first flange, a second flange and a transverse section. The first flange extends in the cross direction and has a first thickness in the load direction. The first flange is not wider than the width in the cross direction. The second flange extends in the cross direction and has a second thickness in the load direction. The second flange is not wider than the width in the cross direction. At least one of the first flange and the second flange has the width in the cross direction. The second thickness is different from the first thickness. The transverse section connects the first flange and the second flange. The first flange, the second flange, and the transverse section are an integrated structure forming the monolithic beam.

According to the method and system disclosed herein, the exemplary embodiments provide a structural system including a monolithic beam that may have improved strength when used as part of a composite beam. For example, in some embodiments, a composite beam including the monolithic beam and associated structures such as concrete and/or studs may have strength that is twenty-five percent or higher than the conventional composite beam including a standard beam the monolithic system replaces and associated structures such as concrete and/or studs.

DETAILED DESCRIPTION

Figure 1:
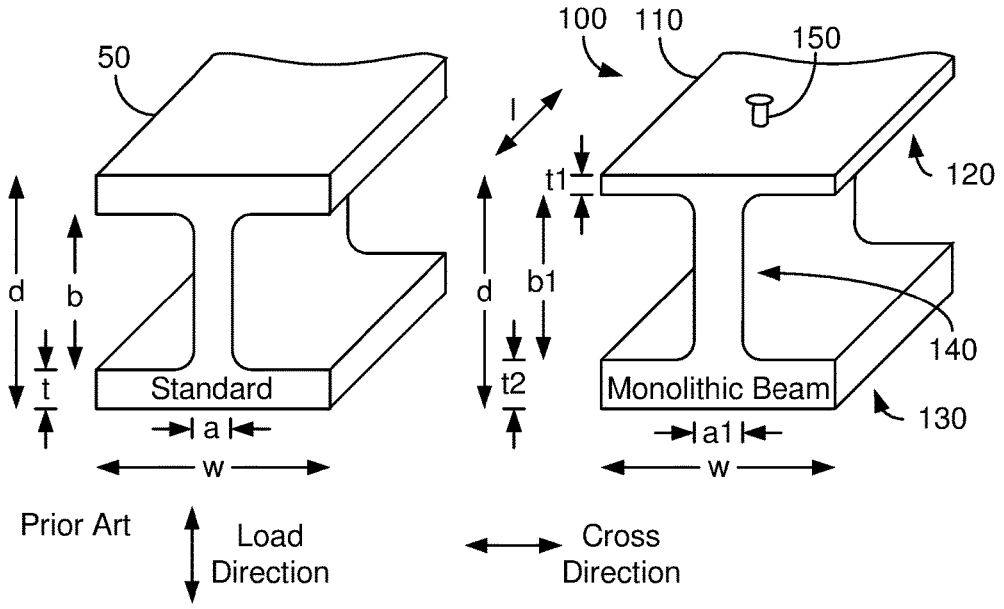
FIG. 1 is a diagram of an exemplary embodiment of a structural system and the standard beam replaceable by the structural system.

The following description is presented to enable one of ordinary skill in the art to make and use the invention and is provided in the context of a patent application and its requirements. Various modifications to the exemplary embodiments and the generic principles and features described herein will be readily apparent. The exemplary embodiments are mainly described in terms of particular methods and systems provided in particular implementations. However, the methods and systems will operate effectively in other implementations. Phrases such as "exemplary embodiment", "one embodiment" and "another embodiment" may refer to the same or different embodiments as well as to multiple embodiments. The embodiments will be described with respect to systems having certain components. However, the systems may include more or less components than those shown, and variations in the arrangement and type of the components may be made without departing from the scope of the invention. The exemplary embodiments will also be described in the context of particular methods having certain steps. However, the method and system operate effectively for other methods having different and/or additional steps and steps in different orders that are not inconsistent with the exemplary embodiments. Thus, the present invention is not intended to be limited to the embodiments shown, but is to be accorded the widest scope consistent with the principles and features described herein. Reference is made in detail to the embodiments of the present general inventive concept, examples of which are illustrated in the accompanying drawings, wherein like reference numerals refer to the like elements throughout.

The embodiments are described below in order to explain the present general inventive concept while referring to the figures. The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Unless defined otherwise, all technical and scientific terms used herein have the same meaning as commonly understood by one of ordinary skill in the art to which this invention belongs. It is noted that the use of any and all examples, or exemplary terms provided herein is intended merely to better illuminate the invention and is not a limitation on the scope of the invention unless otherwise specified.

FIG. 1 is a diagram of an exemplary embodiment of a structural system 100 and the standard beam 50 replaceable by the structural system. For example, a composite beam may include concrete and the structural system 100, which replaces the standard beam 50, and any shear studs. For simplicity, only a portion of the structural system 100 and standard beam 50 are shown in FIG. 1. For clarity, FIG. 1 is not to scale.

The standard beam 50 is an I-beam including top and bottom standard flanges as well as a standard transverse section. Each of the flanges has a width, w, and a thickness, t. Thus, the flanges of the standard beam 50 are the same to within fabrication tolerances. The depth, d, of the standard beam 50 is measured from the top of the standard top flange to the bottom of the standard bottom flange, as shown in FIG. 1. The standard transverse section, or web, has a thickness, a, and a height b. The height b of the standard beam 50 is in the load direction. Thus, the vertical portion of the "I" is in the load direction. In the embodiment shown, the height of the standard transverse section includes the curved regions at the transition between the standard transverse section and the flanges. However, the height could also be measured along the straight portions of the standard transverse section. The standard beam 50 extends in the direction I, substantially perpendicular to the "I" characteristic cross-sectional shape. The standard beam 50 also has a weight per unit length in this direction. The standard beam 50 is typically formed of steel.

The structural system 100 includes a monolithic beam 110 and, in the embodiment shown, an optional shear stud 150. In some embodiments, multiple shear studs 150 may be used with a single monolithic beam. In other embodiments, the shear stud 150 may be omitted. The structural system may also include concrete and/or other materials used in connection with the monolithic beam 110. In the embodiment shown, for example, a composite beam may be formed by the structural system 100 (which includes the monolithic beam 110 and shear studs 150) and concrete (not shown in FIG. 1). Thus, the monolithic beam 110 may replace the standard beam 50 in a composite beam.

The monolithic beam 110 has a characteristic cross-sectional shape that matches that of the standard beam 50. Thus, the monolithic beam 110 is an I-beam. The monolithic beam includes a first flange 120, a second flange 130 and a transverse section 140. As depicted in FIG. 1, the load direction is along the direction that the transverse section 140 extends. This load direction is along the depth, d, in FIG. 1. The cross direction is in the direction that the flanges 120 and 130 extend. In the embodiment shown, the load direction and the cross direction are substantially perpendicular. The load direction is also along the direction in which the load on the monolithic beam 110 is generally placed. During use, the monolithic beam 100, and thus the structural system 100, may be loaded in other directions. As used herein, therefore, the load direction corresponds to the direction between the flanges 120 and 130 and the direction in which the transverse section 140 extends. Similarly, the cross direction corresponds to the direction in which the flanges 120 and 130 extend. The monolithic beam 110 also extends along a direction, I. The monolithic beam 110 may also have a weight per unit length in this direction that is the same as the conventional beam 50. In alternate embodiments, however, the monolithic beam 110 may have a different weight per unit length. The monolithic beam 110 may also be made of steel. However, nothing prevents the use of other materials. In general, it is desirable for the monolithic beam 110 to be formed of the same material(s) as are used for the standard beam 50.

The first flange 120 has a thickness, t1, and, in the embodiment shown, a width, w. The second flange 130 has a thickness, t2, and a width, w. In the embodiment shown, the flanges 120 and 130 have the same width but different thicknesses. In other embodiments, the widths of the flanges 120 and 130 may differ. However neither flange 120 or 130 is wider than w. The transverse section 140 has a height b1 and a width a1. In the embodiment shown, the height of the transverse section 140 includes the curved regions at the transition between the transverse section 140 and the flanges 120 and 130. However, the height could also be measured along the straight portions of the transverse section 140.

The monolithic beam 110 is termed "monolithic" because its components 120, 130 and 140 are integrated together. Stated differently, the monolithic beam 110 may have the shape and components 120, 130 and 140 as described below, as manufactured. For example, the monolithic beam 110 may consist of a single piece of material. In some such embodiments, a rolled steel monolithic beam 110 would have the flanges 120 and 130 and transverse section 140 as-rolled and/or as formed from a single piece of steel. Similarly, an extruded steel beam may be formed from a single piece of steel. In such embodiments, this corresponds to the monolithic beam 110 being free of welds. Alternatively, the monolithic beam 110 may include welds that were made during fabrication of the beam. Such a monolithic beam may be formed if pieces of the beam are welded together during fabrication. For example, the flanges 120 and 130 might be welded to the web 140. In some such embodiments, the flanges 120 and 130 and web 140 are each formed of a single piece of material (e.g. steel). However, post-manufacturing/post-market welds would not be present in the monolithic beam prior to use in construction. For example, a beam having a post-manufacturing additional plate welded to one of the flanges 120 or 130 would not constitute a monolithic beam. However, a monolithic beam 110 might be welded to another beam when the monolithic beam 110 is used in building a structure. Thus, a monolithic beam, such as the monolithic beam 100, is an integrated structure that is free of post-manufacturing welds prior to use in the field and may be entirely free of welds prior to use in the field.

The monolithic beam 110 has the same depth, d, and width, w, as the standard beam 50. The outer measurements of the monolithic beam 110 are thus the same as the standard beam 50. Further, the weight per unit length in the direction I of the monolithic beam 110 may be substantially the same as the standard beam 50. Thus, the monolithic beam should be capable of directly replacing the standard beam 50 in most uses. Stated differently, a user selecting the standard steel beam 50 from a particular table, such as found in Manual of Steel Construction published by the American Institute of Steel Construction, Inc. or any of a variety of reference guides, may replace the standard beam 50 with the monolithic beam 110 knowing that the outer measurements (width, w, and depth, d) as well as the weight per unit length of the monolithic beam 110 matches that of the standard beam 50.

However, the sizes of the flanges 120 and 130 of the monolithic beam 110 differ from that of the standard beam 50. The thickness of the flange 120 that is to be used to support concrete or otherwise directly bear the load carried by the monolithic beam 110 is less than the thickness of the second flange 130 that is further from the load. In other words, $t1<t2$. The minimum thickness of the flange 120 may be limited by the load to be borne by the monolithic beam 110. For example, in some embodiments, t1 is not less than ½ inch thick. In other embodiments, t1 may be not less than three-sixteenth in thick. In some embodiments, the decrease in thickness of the first flange 120 is offset by the increase in thickness of the second flange 130 ($t1+t2=2t$). However, in other embodiments, this is not the case ($t1+t2\neq 2t$). The width of the transverse section 140 may be the same or different from that of the standard beam 50. For example, the width of the transverse section 140 may be adjusted to ensure that the weight per unit length of the monolithic beam 110 matches that of the standard beam 50. For example, if the decrease in thickness of the flange 120 is not offset by the increase in thickness of the second flange 130 ($t1+t2\neq 2t$), then the width of the transverse section 140 may be different from that of the standard beam 50 ($a1\neq a$).

In other embodiments, the monolithic beam 110 may have a different weight per unit length than the standard beam 50. For example, in some embodiments, the outer measurements, d and w, may match those of the standard beam 50. However, the sum of the thicknesses of the flanges may not be the same as that of a standard beam ($t1+t2\neq 2t$). Instead, the weight per unit length of the monolithic beam 110 may be less than that of the standard beam and the sum of the thicknesses of the flanges may be less than that of the standard beam ($t1<t2$; $t1+t2<2t$). As a result, $b1>b$. The geometry of such a beam may be understood as removing some of the material from the top flange, but not adding the material back to the bottom flange ($t2=t$; $t1<t$).

The structural system 100 may have a number of advantages. The monolithic beam 110 may have improved strength and/or stiffness when used in a composite beam. This may allow the composite beam including the monolithic beam 110 to support a higher load than if the composite beam includes the standard beam 50. Stated differently, simply replacing the standard beam 50 with the monolithic beam 110 may result in a composite beam having improved strength and/or stiffness. If the monolithic beam 110 has the same weight per unit length in addition to the same critical dimensions discussed above, this improvement may come simply and at little additional cost. For example, suppose that the standard beam is a W18×35 steel beam. For such a beam, w=6 inches, a=0.425 inches, b=16.85 inches and d=17.7 inches. The monolithic beam 110 corresponds to the W18×35 steel beam, but has flanges of different thicknesses. Suppose that $t1=0.2125$ and $t2=0.6375$ such that $t1+t2=2t$. Other measurements of the monolithic beam 110 match those of the standard beam 50. In such a case, the composite beam incorporating the monolithic beam 110 may have a twenty-five to fifty percent improvement in strength over a composite beam including the standard beam 50. Further, in the embodiment described above, in which the weight per unit length is less than that of a standard beam ($t1<t2$, $t1+t2<2t$, $t1<t$, $t2=t$ and $b1>b$), the performance may still be improved. In some embodiments, monolithic beam 110 having the weight per unit length less than that of a standard beam 50 may have the same strength as a standard beam. Thus, the strength may be improved while less material is used in fabricating the monolithic beam 110.

Because the structural system 100 has the same outer dimensions (depth d and width w) and the same weight per unit length, the structural system may directly replace the standard beam 50. For example, a user might simply consult the well-known tables discussed above, then order and use the monolithic beam 110 or structural system 100 in place of the standard beam 50 of the same dimensions and weight per unit length. Use of the structural system 100 may thus be convenient. The benefits of the structural system 100 may be achieved more cheaply than other methods. An additional flange may be welded onto the standard beam 50 in the field (i.e. when the standard beam 50 is being used to construct a building). This additional flange may improve the strength of the standard beam 50. Changes made in the field may be significantly more expensive because skilled individuals are hired to weld the flange onto the standard beam 50. In contrast, the monolithic beam 110 may have improved strength as-manufactured because of the configuration of the flanges 120 and 130 and the transverse section 140. Thus, the structural system 100 may have higher strength at a lower cost. The structural system 100 may realize these advantages in an environmentally friendly manner. The improved strength is provided without using additional materials, such as the additional flange described above. This translates into less material being used in the structure being built. Thus, resources may be conserved.

Figure 2:
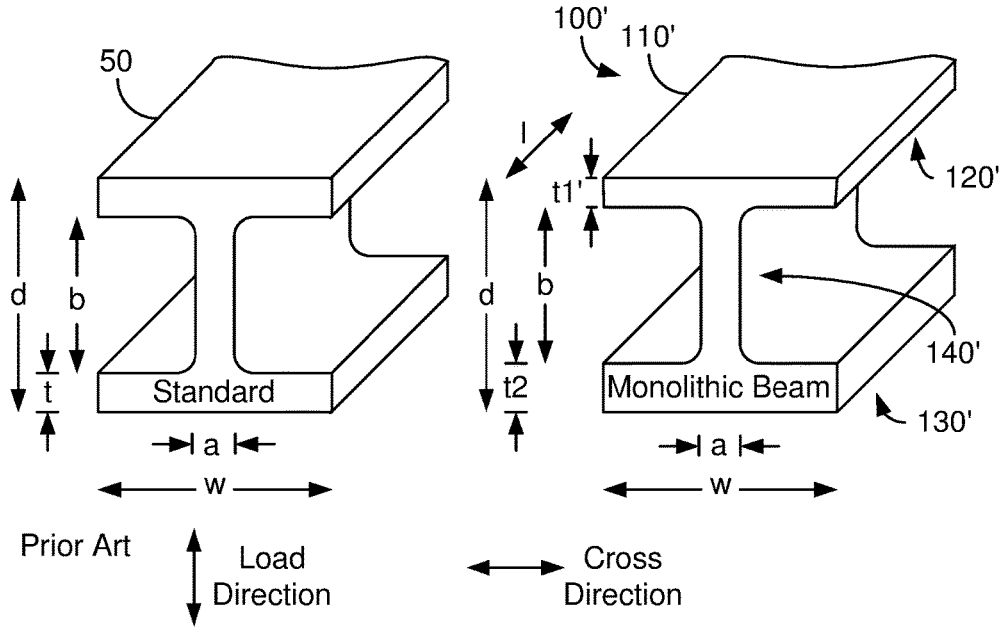
FIG. 2 is a diagram of another exemplary embodiment of a structural system and the standard beam replaceable by the structural system.

FIG. 2 is a diagram of another exemplary embodiment of a structural system 100' and the standard beam 50 replaceable by the structural system. For simplicity, only some components are shown. Further, additional and/or different components may be used. For example, a shear stud, analogous to the shear stud 150 depicted in FIG. 1, may be used in connection with the structural system 100'. For clarity, FIG. 2 is not to scale. The structural system 100' is analogous to the structural system 100. Analogous components in FIG. 2 are thus labeled similarly to those in FIG. 1. For example, the standard beam 50 of FIG. 2 is an I-beam analogous to the standard beam depicted in FIG. 1.

The structural system 100' includes a monolithic beam 110'. The monolithic beam 110' is monolithic as described above. Stated differently, the components of the monolithic beam 110' are integrated together as manufactured and, in at least some embodiments, without welds. Thus, the monolithic beam 110' is as depicted may be as-rolled and formed from a single piece of steel. The monolithic beam 110' has a characteristic cross-sectional shape that matches that of the standard beam 50. The monolithic beam 110' is thus an I-beam. The monolithic beam includes a first flange 120', a second flange 130' and a transverse section 140' that are analogous to the first flange 120, the second flange 130 and the transverse section 140. The monolithic beam 110' also extends along a direction, I and may have a weight per unit length in this direction that is substantially the same as the standard beam 50. The monolithic beam 110' may be made of steel and is generally formed of the same material(s) as the standard beam 50. The monolithic beam 110' may thus replace the standard beam 50 in a composite beam (not shown).

The first flange 120' has a thickness, t1', and, in the embodiment shown, a width, w. The second flange 130' has a thickness, t2, and a width, w. In the embodiment shown, the flanges 120' and 130' have the same width but different thicknesses. Further, the reduction in thickness of the flange 120' is offset by the increase in thickness of the flange 130'. Stated differently, 2t=t1'+t2. The transverse section 140' has a height b and a width a. Thus, the length and width of the transverse section 140' match that of the standard transverse section for the standard beam 50. The monolithic beam 110' has the same depth, d, and width, w, as the standard beam 50. The outer measurements of the monolithic beam 110' are thus the same as the standard beam 50. The inner surfaces of the flanges 120' and 130' are also separated by the same distance (b) as for the standard beam 50. For these reasons, the monolithic beam 110' also has the same weight per unit length in the I direction. Thus, the monolithic beam 110' should be capable of directly replacing the standard beam 50 in most uses.

The structural system 100' may share the benefits of the structural system 100. The monolithic beam 110' may result in a composite beam having improved strength and/or stiffness. This may allow the composite beam including monolithic beam 110' to support a higher load than if the standard beam 50 is included. For example, in some embodiments, the composite beam including monolithic beam 110' may have a twenty-five to fifty percent improvement in strength over that of a composite beam using the standard beam 50. The structural system 100' may also be convenient to use, less expensive and more environmentally friendly.

Figure 3:
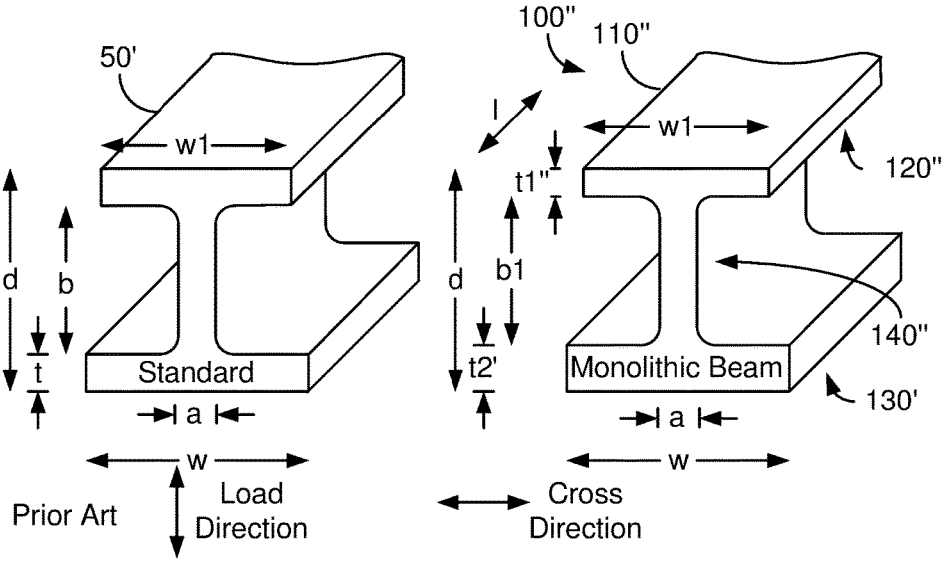
FIG. 3 is a diagram of another exemplary embodiment of a structural system and the standard beam replaceable by the structural system.

FIG. 3 is a diagram of another exemplary embodiment of a structural system 100" and the standard beam 50' replaceable by the structural system. For simplicity, only some components are shown. Further, additional and/or different components may be used. For example, a shear stud, analogous to the shear stud 150 depicted in FIG. 1, may be used in connection with the structural system 100". For clarity, FIG. 3 is not to scale. The structural system 100" is analogous to the structural systems 100 and/or 100'. Analogous components in FIG. 3 are thus labeled similarly to those in FIGS. 1-2. For example, the standard beam 50' of FIG. 3 is an I-beam analogous to the standard beam depicted in FIG. 1. However, as can be seen in FIG. 3, the top flange of the beam 50' is not as wide as the bottom flange. Instead, the top flange has a width w1.

The structural system 100" includes a monolithic beam 110". The monolithic beam 110" is monolithic as described above. The monolithic beam 110" includes a first flange 120", a second flange 130" and a transverse section 140" that are analogous to the first flange 120/120', the second flange 130/130' and the transverse section 140/140'. The monolithic beam 110" has a characteristic cross-sectional shape that matches that of the standard beam 50'. The monolithic beam 110" is thus an I-beam with one flange 120" having a width w1 and the other flange 130' having a width w. The monolithic beam 110" also extends along a direction, I and may have a weight per unit length in this direction that is substantially the same as the standard beam 50'. The monolithic beam 110" may be made of steel and is generally formed of the same material(s) as the standard beam 50'.

The first flange 120" has a thickness, t1", and, in the embodiment shown, a width, w1. The second flange 130" has a thickness, t2', and a width, w. In the embodiment shown, the reduction in thickness of the flange 120" is offset by the increase in thickness of the flange 130". Stated differently, 2t=t1"+t2'. In other embodiments, the thicknesses of the flanges 120" and 130" are offset such that the sum of the weight of the flanges 120" and 130" is equal to the sum of the weight of the flanges of the beam 50'. The transverse section 140' has height b and width a. Thus, the length and width of the transverse section 140' match that of the standard transverse section for the standard beam 50. In other embodiments, the width of the transverse section 140" may also be used to ensure that the weight per unit length of the monolithic beam 110" is the same as that of the standard beam 50'. The monolithic beam 110" has the same depth, d, and width, w, as the standard beam 50'. The outer measurements of the monolithic beam 110" are thus the same as the standard beam 50'. The inner surfaces of the flanges 120" and 130" may be separated by the same distance (b) as for the standard beam 50'. For these reasons, the monolithic beam 110" may also have the same weight per unit length in the I direction. Thus, the monolithic beam 110" should be capable of directly replacing the standard beam 50' in most uses.

The structural system 100" may have a number of advantages. The composite beam including the monolithic beam 110" may have improved strength and/or stiffness, which may allow the composite beam to support a higher load than if the standard beam 50' is used. In some embodiments, the composite beam using the monolithic beam 110" may have a twenty-five to fifty percent improvement in strength of the standard beam 50'. The structural system 100" may also be convenient to use, less expensive and more environmentally friendly.

Figure 4:
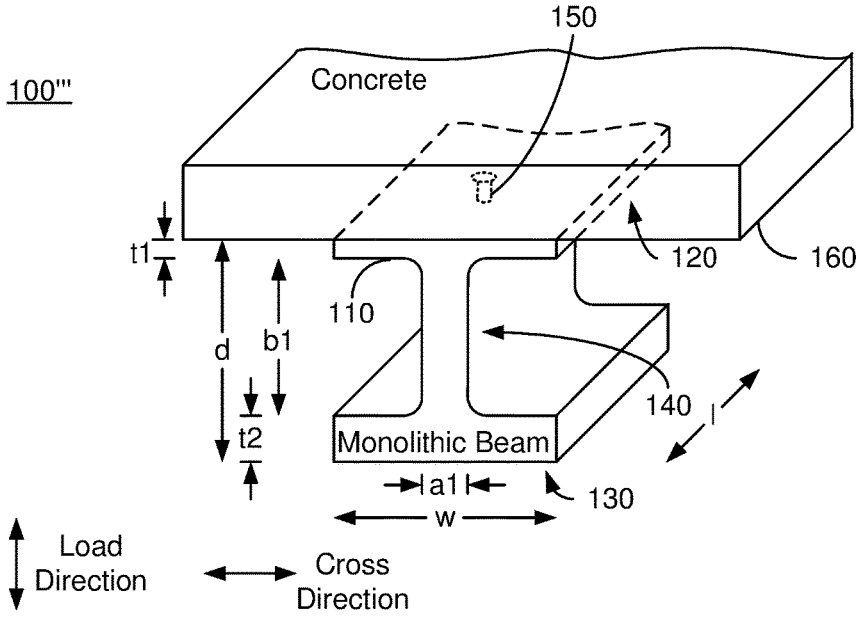
FIG. 4 is a diagram of an exemplary embodiment of a structural system as used in a composite beam.

FIG. 4 is a diagram of another exemplary embodiment of a structural system 100'". For simplicity, only some components are shown. Further, additional and/or different components may be used. The structural system 100'" includes a monolithic beam 110 and shear stud 150. These are components of the system 100 depicted in FIG. 1. In addition, the structural system 100'" includes concrete 160 that is loading the first flange 120. Thus, the system depicted in FIG. 4 may be considered to be a composite beam using the monolithic beam 110, shear stud 150 and concrete 160. The monolithic beam 110 is thus configured such that the concrete 160 exerts a load on the thinner flange 120. Thus, without more, the load from the concrete 160 would tend to flex the monolithic beam 110 such that the bottom surface of the bottom flange 130 is under tensile stress (e.g. bowed down) while the top surface of the top flange 120 is subject to compressive stress.

The structural system/composite beam 100''' may share the benefits of the structural systems 100, 100' and/or 100''. The composite beam 100''' using the monolithic beam 110 may have improved strength and/or stiffness, which may allow the composite beam 100''' to support a higher load. Thus, the load of concrete 160 supported may be increased. In some embodiments, the composite beam may have a twenty-five to fifty percent improvement in strength. The structural system 100''' may also be convenient to use, less expensive and more environmentally friendly.

Figure 5:
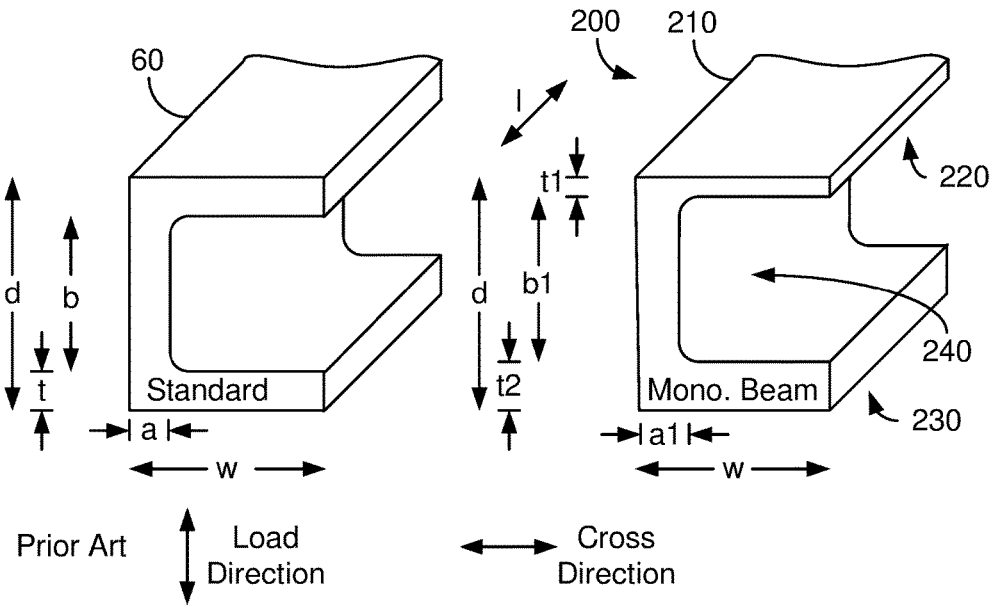
FIG. 5 is a diagram of another exemplary embodiment of a structural system and the standard beam replaceable by the structural system.

FIG. 5 is a diagram of another exemplary embodiment of a structural system 200 and the standard beam 60 replaceable by the structural system 200. For simplicity, only some components are shown. Further, additional and/or different components may be used. For example, a shear stud, analogous to the shear stud 150 depicted in FIG. 1, may be used in connection with the structural system 200. For clarity, FIG. 5 is not to scale. The structural system 200 is analogous to the structural systems 100, 100', 100'' and/or 100'''. Analogous components in FIG. 5 are thus labeled similarly to those in FIGS. 1-4. For example, the standard beam 60 of FIG. 5 is a channel beam (or c-beam) that is analogous to the I-beams 50 and/or 50'. However, as can be seen in FIG. 5, the transverse section of the beam 60 does not connect the central regions of the flanges. Instead, the transverse section connects the flanges at their end. The flanges of the standard beam 60 are the same width, w. However, the flanges could have different widths.

The structural system 200 includes a monolithic beam 210. In some embodiments, the structural system 200 may also include other components. For example, the structural system might include shear stud(s) analogous to the shear stud 150 depicted in FIG. 1. The monolithic beam 210 is analogous to the monolithic beams 110, 110' and 110'', except for the characteristic cross-sectional shape. The monolithic beam 210 is monolithic as described above. The monolithic beam 210 includes a first flange 220, a second flange 230 and a transverse section 240 that are analogous to the first flange 120/120'/120'', the second flange 130/130'/130'' and the transverse section 140/140'/140''. However, the transverse section 240 connects the flanges 220 and 230 at their ends. The monolithic beam 210 has a characteristic cross-sectional shape that matches that of the standard beam 60. The monolithic beam 210 is thus a c-beam. The monolithic beam 210 also extends along a direction, I and may have a weight per unit length in this direction that is substantially the same as the standard beam 60. The monolithic beam 210 may be made of steel and is generally formed of the same material(s) as the standard beam 60.

The first flange 220 has a thickness, t1, and, in the embodiment shown, a width, w. The second flange 230 has a thickness, t2, and a width, w. In other embodiments, the width(s) of the flanges 220 and 230 may differ. For example, the flanges 220 and 230 may have widths that match those of the corresponding flanges of the standard beam 60.

In the embodiment shown, the reduction in thickness of the flange 220 is offset by the increase in thickness of the flange 230. Stated differently, $2t=t1+t2$ or the sum of the weights of the flanges of the standard beam 60 is equal to the sum of the weights of the flanges 220 and 230. The transverse section 240 has height b1 and width a1. In some embodiments, $b1=b$ and/or $a1=a$. However, in other embodiments, these may differ. Thus, the length and width of the transverse section 240 match that of the standard transverse section for the standard beam 60. In other embodiments, the width of the transverse section 240 may also be used to ensure that the weight per unit length of the monolithic beam 210 is the same as that of the standard beam 60. The monolithic beam 210 has the same depth, d, and width, w, as the standard beam 60. The outer measurements of the monolithic beam 210 are thus the same as the standard beam 60. The inner surfaces of the flanges 220 and 230 may be separated by the same distance (b) as for the standard beam 60. For these reasons, the monolithic beam 210 may also have the same weight per unit length in the I direction. Thus, the monolithic beam 210 should be capable of directly replacing the standard beam 60 in most uses.

In other embodiments, the monolithic beam 210 may have a different weight per unit length than the standard beam 60. For example, in some embodiments, the outer measurements, d and w, may match those of the standard beam 60. However, the sum of the thicknesses of the flanges may not be the same as that of a standard beam ($t1+t2\neq 2t$). Instead, the weight per unit length of the monolithic beam 210 may be less than that of the standard beam and the sum of the thicknesses of the flanges may be less than that of the standard beam ($t1<t2$; $t1+t2<2t$). As a result, $b1>b$. The geometry of such a beam may be understood as removing some of the material from the top flange, but not adding the material back to the bottom flange ($t1<t$; $t2=t$).

The structural system 200 may have a number of advantages. A composite beam using the monolithic beam 210 may have improved strength and/or stiffness. This may allow the composite beam incorporating monolithic beam 210 to support a higher load on the top flange 220 than if the standard beam 60 is used. Further, monolithic beam 210 of the structural system 200 has a different cross-section than the monolithic beams 110, 110', and 110''. Further, in the embodiment described above, in which the weight per unit length is less than that of a standard beam ($t1<t2$, $t1+t2<2t$, $t1<t$, $t2=t$ and $b1>b$), the performance may still be improved. In some embodiments, monolithic beam 210 having the weight per unit length less than that of a standard beam 50 may have the same strength as a standard beam. Thus, the strength may be improved while less material is used in fabricating the monolithic beam 210. The structural system 200 may also be convenient to use, less expensive and more environmentally friendly.

Figure 6:
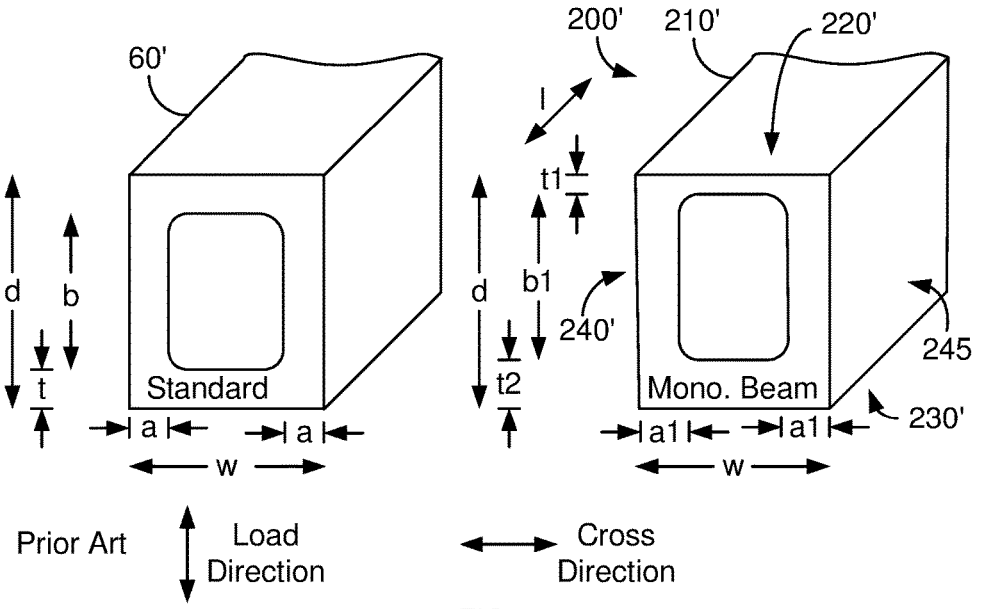
FIG. 6 is a diagram of another exemplary embodiment of a structural system and the standard beam replaceable by the structural system.

FIG. 6 is a diagram of another exemplary embodiment of a structural system 200' and the standard beam 60' replaceable by the structural system 200'. For simplicity, only some components are shown. Further, additional and/or different components may be used. For example, a shear stud, analogous to the shear stud 150 depicted in FIG. 1, may be used in connection with the structural system 200'. For clarity, FIG. 6 is not to scale. The structural system 200' is analogous to the structural systems 100, 100', 100'', 100''' and/or 200. Analogous components in FIG. 6 are thus labeled similarly to those in FIGS. 1-5. For example, the standard beam 60' of FIG. 5 is a rectangular beam having a central channel that is analogous to the beams 50, 50' and/or 60. However, as can be seen in FIG. 6, the transverse section of the beam 60' does not connect the central regions of the flanges. Instead, the transverse section connects the flanges at their end. The flanges of the standard beam 60' are the same width, w, and the same width t.

The structural system 200' includes a monolithic beam 210'. In some embodiments, the structural system 200' may also include other components. For example, the structural system might include shear stud(s) analogous to the shear stud 150 depicted in FIG. 1. The monolithic beam 210' is analogous to the monolithic beams 110, 110', 110" and 210, except for the characteristic cross-sectional shape. The monolithic beam 210' is monolithic as described above. The monolithic beam 210' includes a first flange 220', a second flange 230' and a transverse section 240' that are analogous to the first flange 120/120'/120"/220, the second flange 130/130'/130"/230 and the transverse section 140/140'/140"/240. The transverse section 240' connects the flanges 220' and 230' at their ends. In addition, the monolithic beam 210' includes an additional transverse section 245 that connects the flanges 220' and 230' at their opposite ends. The monolithic beam 210' has a characteristic cross-sectional shape that matches that of the standard beam 60'. The monolithic beam 210' also extends along a direction, I and may have a weight per unit length in this direction that is substantially the same as the standard beam 60'. The monolithic beam 210' may be made of steel and is generally formed of the same material(s) as the standard beam 60'. However, the monolithic beam 210 would not be rolled. A single sheet of steel (having a varying thickness) might be bent and welded during manufacturing. Alternatively, the monolithic beam 210' might be extruded. In other embodiments, four pieces of steel (two flanges and two transverse section) might be welded together during manufacturing.

The first flange 220' has a thickness, t1, and, in the embodiment shown, a width, w. The second flange 230' has a thickness, t2, and a width, w. In other embodiments, the width(s) of the flanges 220' and 230' may differ. For example, the flanges 220' and 230' may have widths that match those of the corresponding flanges of the standard beam 60'. In the embodiment shown, the reduction in thickness of the flange 220' is offset by the increase in thickness of the flange 230'. Stated differently, $2t=t1+t2$ or the sum of the weights of the flanges of the standard beam 60' is equal to the sum of the weights of the flanges 220' and 230'. In other embodiments, the thickness changes may not be offset and/or the sum of the weights of the flanges of the standard beam 60' may not be the same as the sum of the weights of the flanges 220' and 230'. The transverse sections 240' and 245 each has height b1 and width a1. In some embodiments, $b1=b$ and/or $a1=a$. However, in other embodiments, these may differ. Thus, the length and width of the transverse sections 240' and 245 match that of the corresponding standard transverse sections for the standard beam 60'. In other embodiments, the width of the transverse section 240' and/or 245 may also be used to ensure that the weight per unit length of the monolithic beam 210' is the same as that of the standard beam 60'. The monolithic beam 210' has the same depth, d, and width, w, as the standard beam 60'. The outer measurements of the monolithic beam 210' are thus the same as the standard beam 60'. The inner surfaces of the flanges 220' and 230' may be separated by the same distance (b) as for the standard beam 60'. For these reasons, the monolithic beam 210' may also have the same weight per unit length in the I direction. Thus, the monolithic beam 210 should be capable of directly replacing the standard beam 60' in most uses.

In other embodiments, the monolithic beam 210' may have a different weight per unit length than the standard beam 50'. For example, in some embodiments, the outer measurements, d and w, may match those of the standard beam 50'. However, the sum of the thicknesses of the flanges may not be the same as that of a standard beam ($t1+t2\neq 2t$). Instead, the weight per unit length of the monolithic beam 210' may be less than that of the standard beam and the sum of the thicknesses of the flanges may be less than that of the standard beam ($t1<t2$; $t1+t2<2t$). As a result, $b1>b$. The geometry of such a beam may be understood as removing some of the material from the top flange, but not adding the material back to the bottom flange ($t1<t$; $t2=t$).

The structural system 200' may share the advantages of the structural systems 100, 100', 100", 100'" and/or 200. The composite beam including monolithic beam 210' may have improved strength and/or stiffness. This may allow the composite beam using the monolithic beam 210' to support a higher load than a composite beam including the standard beam 60'. The structural system 200' may also be convenient to use, less expensive and more environmentally friendly.

Figure 7:
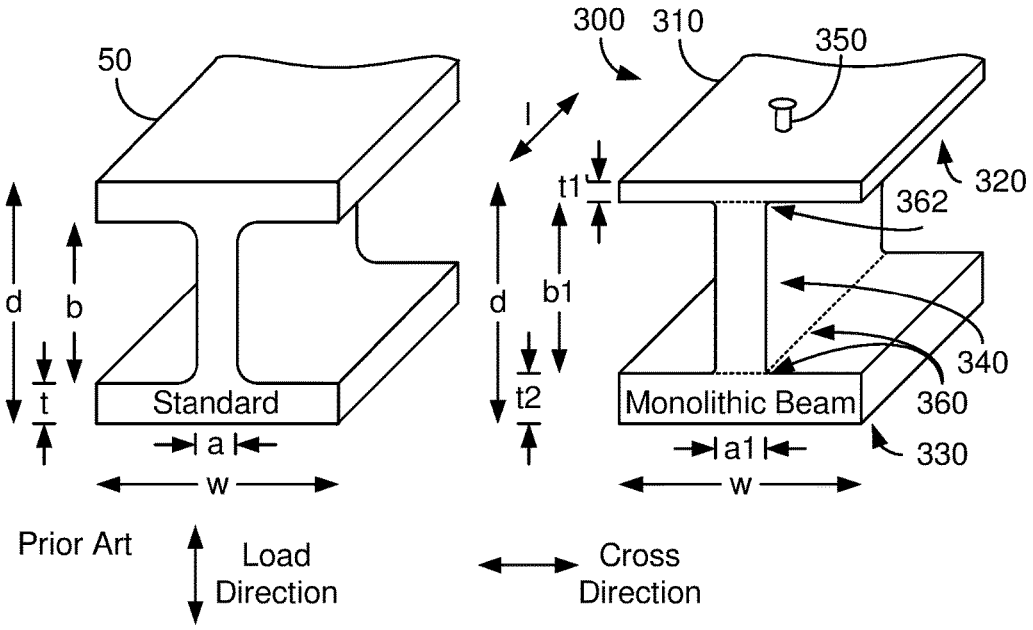
FIG. 7 is a diagram of another exemplary embodiment of a structural system and the standard beam replaceable by the structural system.

FIG. 7 is a diagram of another exemplary embodiment of a structural system 300 and the standard beam 50 replaceable by the structural system. For simplicity, only some components are shown. Further, additional and/or different components may be used. For example, a shear stud 350, analogous to the shear stud 150 depicted in FIG. 1, may be used in connection with the structural system 300. For clarity, FIG. 7 is not to scale. The structural system 300 is analogous to the structural system(s) 100, 100', 100", 200 and 200'. Analogous components in FIG. 7 are thus labeled similarly to those in FIG. 1. For example, the standard beam 50 of FIG. 7 is an I-beam analogous to the standard beam depicted in FIG. 1.

The structural system 300 includes a monolithic beam 310 having flanges 320 and 330 and transverse section 340. The monolithic beam 310 is monolithic as described above. Stated differently, the components of the monolithic beam 310 are integrated together as manufactured. The monolithic beam 310 has a characteristic cross-sectional shape that matches that of the standard beam 50. The monolithic beam 310 is thus an I-beam. The monolithic beam includes a first flange 320, a second flange 330 and a transverse section 340 that are analogous to the first flange 120, the second flange 130 and the transverse section 140. The monolithic beam 310 also extends along a direction, I and may have a weight per unit length in this direction that is substantially the same as the standard beam 50. The monolithic beam 310 may be made of steel and is generally formed of the same material(s) as the standard beam 50. The monolithic beam 310 may thus replace the standard beam 150 in a composite beam (not shown).

The first flange 320 has a thickness, t1', and, in the embodiment shown, a width, w. The second flange 330 has a thickness, t2, and a width, w. In the embodiment shown, the flanges 320 and 330 have the same width but different thicknesses. Further, the reduction in thickness of the flange 320 may be offset by the increase in thickness of the flange 330. Stated differently, $2t=t1'+t2$. The transverse section 340 has a height b and a width a. Thus, the length and width of the transverse section 340 match that of the standard transverse section for the standard beam 50. The monolithic beam 310 has the same depth, d, and width, w, as the standard beam 50. The outer measurements of the monolithic beam 310 are thus the same as the standard beam 50. The inner surfaces of the flanges 320 and 330 are also separated by the same distance (b) as for the standard beam 50. For these reasons, the monolithic beam 310 also has the same weight per unit length in the I direction. Thus, the monolithic beam 310 should be capable of directly replacing the standard beam 50 in most uses. However, in other embodiments, the monolithic beam 310 might be configured differently. For example, the monolithic beam 310 may be configured as the beam(s) 110', 110", 210 (for a different cross-sectional shape) or 210' (again, for a different cross-section).

In other embodiments, the monolithic beam 310 may have a different weight per unit length than the standard beam 50. For example, in some embodiments, the outer measurements, d and w, may match those of the standard beam 50. However, the sum of the thicknesses of the flanges may not be the same as that of a standard beam ($t1+t2 \neq 2t$). Instead, the weight per unit length of the monolithic beam 310 may be less than that of the standard beam and the sum of the thicknesses of the flanges may be less than that of the standard beam ($t1<t2$; $t1+t2<2t$). As a result, $b1>b$. The geometry of such a beam may be understood as removing some of the material from the top flange, but not adding the material back to the bottom flange ($t1<t$; $t2=t$).

The monolithic beam 310 also includes welds 360 and 362, shown as dashed lines in FIG. 7. Although described as welds, another mechanism may be used to affix the sections 320, 330 and 340 together. Thus, the monolithic beam 300 is not free of welds. Instead, the beam 310 is fabricated by welding the flanges 320 and 330 to the transverse section 340. However, the monolithic beam 310 is still considered to be a monolithic beam because there are no after-market welds. Stated differently, the only welds in the monolithic beam 310 are made during assembly of the beam. Thus, the flange 330 as manufactured is thicker than the flange 320.

The structural system 300 may share the benefits of the structural system(s) 100, 100', 100", 100'", 200 and/or 200'. The monolithic beam 310 may result in a composite beam have improved strength and/or stiffness. This may allow the composite beam including monolithic beam 310 to support a higher load than if the standard beam 50 is included. In some instances, the monolithic beam 310 may also be cheaper to manufacture, for example in an area in which labor (e.g. welding) is inexpensive. The structural system 300 may also be convenient to use, less expensive and more environmentally friendly.

Figure 8:
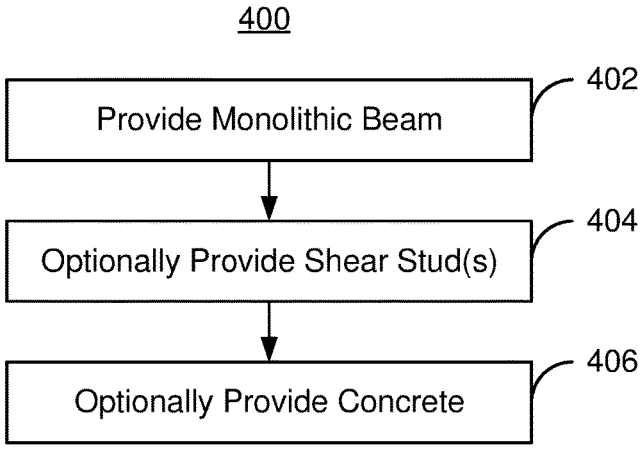
FIG. 8 is a flow chart depicting an exemplary embodiment of a method for providing a structural system.

FIG. 8 is a flow chart depicting an exemplary embodiment of a method 400 for fabricating a structural system such as the structural system 100, 100', 100", 100'", 200, 200' and/or 300. For simplicity, some steps may be omitted or combined. The method 400 is described in the context of the structural system 100. However, the method 400 may be used for other structural systems.

The monolithic beam 110 is provided, via step 402. Step 402 may include configuring the flanges 120 and 130 as well as the transverse section 140. In some embodiments, step 402 also includes providing the transverse section 245. Step 402 provides the monolithic beam, for example by rolling the beam 110. In other embodiments, the monolithic beam, such as the beam 210', might be extruded. Thus, the beam 110 is monolithic as manufactured and may be free of welds. In other embodiments, the monolithic beam 110 may include welds from manufacturing, but be free of post-manufacturing welds. For example, step 402 may include bending a sheet of steel and welding the edges to form the monolithic beam 210 or welding the flanges to a transverse section to form the monolithic beam 310.

The shear stud(s) 150 may optionally be provided, via step 404. Step 404 may be performed in the field, after manufacture of the monolithic beam 110. For example, the shear stud(s) may be welded to the monolithic beam 110. In other embodiments, step 404 may be performed in another manner and/or at another time.

The concrete may be provided, via step 406. For example, the concrete 160 depicted in FIG. 4 may be provided in the field, as the monolithic beam 110 is used. Thus, steps 402, 404 and 406 may together be considered to provide a composite beam that incorporates the monolithic beam provided in step 402.

Using the method 400, the structural system 100, 100', 100", 100", 200, 200' and/or 300 or an analogous structural system may be provided. Thus, one or more of the benefits described herein may be achieved.

Figure 9:
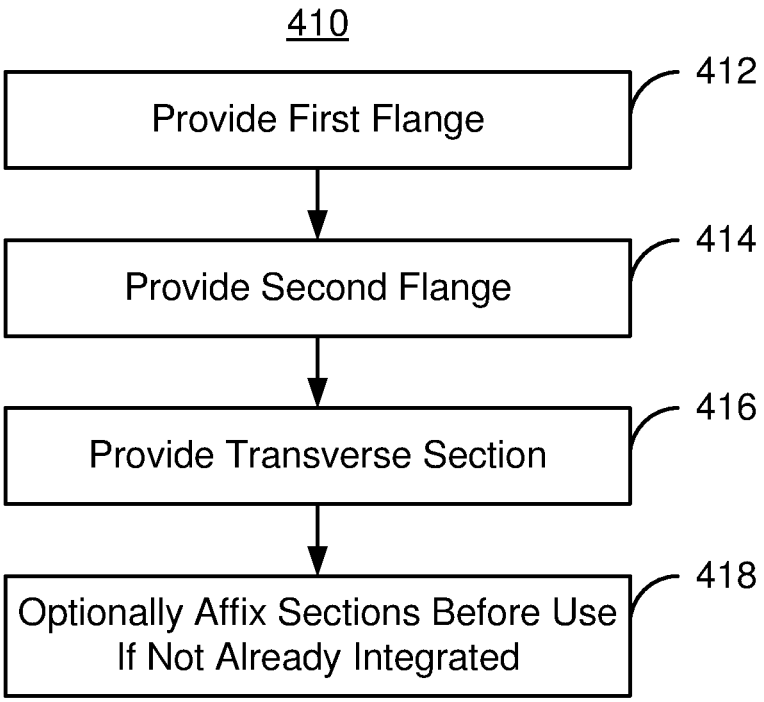
FIG. 9 is a flow chart depicting another exemplary embodiment of a method for providing a monolithic beam for a structural system.

FIG. 9 is a flow chart depicting an exemplary embodiment of a method 410 for providing a monolithic beam such as the monolithic beam 110, 110', 110", 210, 210' and/or 310. For simplicity, some steps may be omitted or combined. The method 410 is described in the context of the monolithic beam 110 and structural system 110. However, the method 410 may be used for other monolithic beams and/or other structural systems.

The flanges 120 and 130 are configured, via steps 412 and 414. In some embodiments, steps 412 and 414 may be performed together as the flanges 120 and 130 may be formed substantially simultaneously. The transverse section 140 is also provided, via step 416. In some embodiments, defining/providing the flanges 120 and 130 also defines the transverse section 140. Thus, steps 412, 414 and 416 may be performed together in a manner analogous to the method 450, described below. For example, the flanges 120 and 130 and transverse section 140 may be formed when the monolithic beam 110 is rolled. Alternatively, the monolithic beam may be extruded. Thus, the flanges and transverse section(s) are defined together as the beam (such as the beam 210' or a beam 110 or 100') exits the extruder. In other embodiments, these features may be separately formed. For example, the flanges and transverse section(s) may be formed by rolling a sheet of steel to have different thicknesses for each section. Alternatively, the pieces for the flanges and web may be cut. These sections are then affixed together, via step 418. Step 418 is performed if steps 412-416 do not form the beam. For example, step 418 may include bending a sheet of steel having varying thicknesses and welding the edges together to form the beam 210'. Alternatively, step 418 may include welding the flanges to the transverse section, as for the monolithic beam 310.

Using the method 410, the monolithic beam 110, 110', 110", 210, 210', 310 and/or an analogous monolithic beam may be provided. Thus, the benefits described herein may be achieved.

Figure 10:
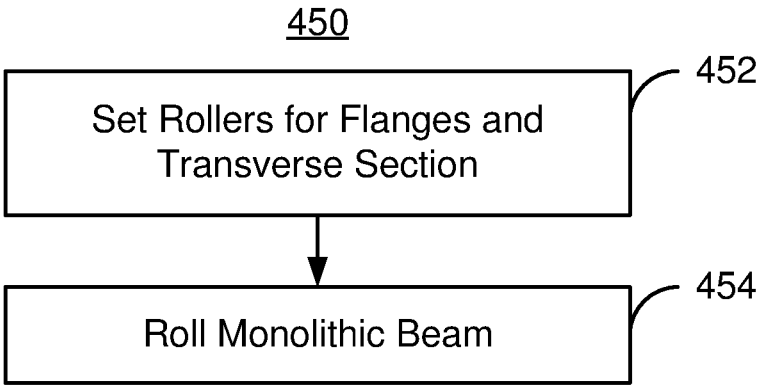
FIG. 10 is a flow chart depicting another exemplary embodiment of a method for providing a monolithic beam for a structural system.

FIG. 10 is a flow chart depicting an exemplary embodiment of a method 450 for providing a monolithic beam that can be free of post-manufacturing or during manufacturing welds, such as the monolithic beam 110, 110', 110", 210 and/or 210'. For simplicity, some steps may be omitted or combined. The method 450 is described in the context of the monolithic beam 110 and structural system 110. However, the method 450 may be used for other monolithic beams and/or other structural systems. The monolithic beam 110 provided using the method 450 is a rolled beam.

The rollers for defining the flanges 120 and 130 as well as the transverse section are set, via step 452. The monolithic beam 110 is then rolled using these settings, via step 454. Thus, the flanges 120 and 130 and the transverse section 140 are defined by rolling. The monolithic beam 110 that is free of welds may thus be manufactured.

Using the method 450, the monolithic beam 110, 110', 110", 210 and/or an analogous monolithic beam may be provided. Thus, the benefits described herein may be achieved.

A method and system for a structural system has been disclosed. The present invention has been described in accordance with the embodiments shown, and there could be variations to the embodiments, and any variations would be within the spirit and scope of the present invention. Accordingly, many modifications may be made by one of ordinary skill in the art without departing from the spirit and scope of the appended claims.

I claim:

1. A structural system for replacing a standard I-beam having a weight per unit length, a depth in a load direction, and a width in a cross direction substantially perpendicular to the load direction, the standard I-beam including a standard top flange extending in the cross direction, a standard bottom flange extending in the cross direction and a standard transverse section extending in the load direction, the standard transverse section connecting a first standard central portion of the standard top flange and a bottom standard central portion of the standard bottom flange, the standard top flange and the standard bottom flange each having a standard thickness, the structural system comprising:

a monolithic I-beam having the characteristic cross-sectional shape and the depth in the load direction, the monolithic beam including a top flange extending in the cross direction and having a top thickness in the load direction, the top flange being not wider than the width in the cross direction;

a bottom flange extending in the cross direction and having a bottom thickness in the load direction, the bottom flange being not wider than the width in the cross direction, at least one of the top flange and the bottom flange having the width in the cross direction, the bottom thickness being different from the top thickness; and a transverse section connecting a top central portion the top flange and a bottom central portion the bottom flange, the top flange, the bottom flange, and the transverse section being an integrated structure forming the monolithic I-beam, wherein the standard beam has a first standard flange, a second standard flange and a standard transverse section connecting the first standard flange and the second standard flange, the first standard flange extending in the cross direction and having a first standard thickness in the load direction, the first flange being not wider than the width in the cross direction, the second standard flange extending in the cross direction and having a second standard thickness in the load direction, the second standard flange being not wider than the width in the cross direction, at least one of the first standard flange and the second standard flange having the width in the cross direction, the top thickness being less than the first standard thickness, the bottom thickness being substantially equal to the second standard thickness, wherein the monolithic beam has a beam weight per unit length less than the weight per unit length of the standard beam; and at least one shear stud coupled with the top flange.

2. The structural system of claim 1 wherein the top flange has a first width, the bottom flange has a second width, the first standard flange has a first standard width substantially equal to the first width and the second standard flange has a second standard width substantially equal to the second width.

3. A structural system for replacing a standard beam having a weight per unit length, a depth in a load direction, a characteristic cross-sectional shape and a width in a cross direction substantially perpendicular to the load direction, the structural system comprising:

a monolithic beam having the characteristic cross-sectional shape and the depth in the load direction, the monolithic beam including a first flange extending in the cross direction and having a first thickness in the load direction, the first flange being not wider than the width in the cross direction;

a second flange extending in the cross direction and having a second thickness in the load direction, the second flange being not wider than the width in the cross direction, at least one of the first flange and the second flange having the width in the cross direction, the second thickness being different from the first thickness; and a transverse section connecting the first flange and the second flange, the first flange, the second flange, and the transverse section being an integrated structure forming the monolithic beam, wherein the standard beam has a first standard flange, a second standard flange and a standard transverse section connecting the first standard flange and the second standard flange, the first standard flange extending in the cross direction and having a first standard thickness in the load direction, the first standard flange being not wider than the width in the cross direction, the second standard flange extending in the cross direction and having a second standard thickness in the load direction, the second standard flange being not wider than the width in the cross direction, at least one of the first standard flange and the second standard flange having the width in the cross direction, the first thickness being less than the first standard thickness, the second thickness being substantially equal to the second standard thickness;

wherein the monolithic beam has a beam weight per unit length less than the weight per unit length of the standard beam.

4. The structural system of claim 3 wherein the first flange has a first width, the second flange has a second width, the first standard flange has a first standard width substantially equal to the first width and the second standard flange has a second standard width substantially equal to the second width.

5. The structural system of claim 3 wherein the characteristic cross-section shape is an I.

6. The structural system of claim 3 wherein the monolithic beam further includes:

an additional transverse section extending in the load direction and connecting the first flange and the second flange, the additional transverse section, the first flange, the second flange, and the transverse section being the integrated structure forming the monolithic beam.

7. The structural system of claim 3 further comprising:

at least one shear stud coupled with the first flange of the monolithic beam, the first thickness being less than the second thickness.

8. The structural system of claim 3 wherein the monolithic beam is weld-free.

9. The structural system of claim 3 wherein the monolithic beam includes at least one weld as-manufactured.

10. The structural system of claim 3 wherein the first flange, the second flange, and the transverse section are the integrated structure forming the monolithic beam as manufactured.

11. A method for providing a structural system for replacing a standard beam having a weight per unit length, a depth in a load direction, a characteristic cross-sectional shape and a width in a cross direction substantially perpendicular to the load direction, the method comprising:

providing a monolithic beam having the characteristic cross-sectional shape and the depth in the load direction, the step of providing the monolithic beam including forming a first flange, a second flange and a transverse section, the first flange extending in the cross direction and having a first thickness in the load direction, the first flange being not wider than the width in the cross direction, the second flange extending in the cross direction and having a second thickness in the load direction, the second flange being not wider than the width in the cross direction, at least one of the first flange and the second flange having the width in the cross direction, the second thickness being different from the first thickness, the transverse section connecting the first flange and the second flange, the first flange, the second flange, and the transverse section being an integrated structure forming the monolithic beam, wherein the standard beam has a first standard flange, a second standard flange and a standard transverse section connecting the first standard flange and the second standard flange, the first standard flange extending in the cross direction and having a first standard thickness in the load direction, the first standard flange being not wider than the width in the cross direction, the second standard flange extending in the cross direction and having a second standard thickness in the load direction, the second standard flange being not wider than the width in the cross direction, at least one of the first standard flange and the second standard flange having the width in the cross direction, the second thickness being different from the first thickness, the first thickness being less than the first standard thickness, the second thickness being substantially equal to the second standard thickness; and wherein the monolithic beam has a beam weight per unit length less than the weight per unit length of the standard beam.

12. The method of claim 11 wherein the first flange has a first width, the second flange has a second width, the first standard flange has a first standard width substantially equal to the first width and the second standard flange has a second standard width substantially equal to the second width.

13. The method of claim 11 wherein the step of providing the monolithic beam further includes:

rolling the monolithic beam to form the first flange, the second flange and the transverse section.

14. The method of claim 11 wherein the step of rolling the monolithic beam includes:

setting a plurality of rollers such that the characteristic cross-section shape is an I.

15. The method of claim 11 wherein the standard beam has a first standard flange, a second standard flange and a standard transverse section connecting the first standard flange and the second standard flange, the first standard flange extending in the cross direction and having a first standard thickness in the load direction, the first flange being not wider than the width in the cross direction, the second standard flange extending in the cross direction and having a second standard thickness in the load direction, the second standard flange being not wider than the width in the cross direction, at least one of the first standard flange and the second standard flange having the width in the cross direction, the second thickness being different from the first thickness, the first thickness plus the second thickness being equal to the first standard thickness plus the second standard thickness.

16. The method of claim 11 wherein the first standard thickness equals the second standard thickness and wherein a first difference between the first thickness and the first standard thickness is equal to a second difference between the second standard thickness and the second thickness.

17. The method of claim 11 wherein the step of providing the monolithic beam further includes:

forming an additional transverse section extending in the load direction and connecting the first flange and the second flange, the additional transverse section, the first flange, the second flange, and the transverse section being the integrated structure forming the monolithic beam.

18. The method of claim 11 wherein the step of providing the monolithic beam provides the first flange, the second flange, and the transverse section such that the monolithic beam is free of welds as manufactured.

* * * * *